US010442205B2

(12) United States Patent
Crespi Serrano et al.

(10) Patent No.: US 10,442,205 B2
(45) Date of Patent: Oct. 15, 2019

(54) PRINTING FLUID CARTRIDGE FOR A PUMPED PRINTING FLUID SYSTEM

(71) Applicant: Hewlett-Packard Development Company, L.P., Houston, TX (US)

(72) Inventors: Albert Crespi Serrano, Sant Cugat del Valles (ES); Joan Albert Miravet Jimenez, Sant Cugat del Valles (ES); David Toussaint, Barcelona (ES); Aleix Fort Filgueira, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/765,648

(22) PCT Filed: Dec. 22, 2015

(86) PCT No.: PCT/EP2015/080960
§ 371 (c)(1),
(2) Date: Apr. 3, 2018

(87) PCT Pub. No.: WO2017/108094
PCT Pub. Date: Jun. 29, 2017

(65) Prior Publication Data

US 2019/0077160 A1 Mar. 14, 2019

(51) Int. Cl.
*B41J 2/175* (2006.01)
*B41J 2/19* (2006.01)

(52) U.S. Cl.
CPC ..... *B41J 2/17506* (2013.01); *B41J 2/175* (2013.01); *B41J 2/17513* (2013.01);
(Continued)

(58) Field of Classification Search
CPC ..... B41J 2/17506; B41J 2/17513; B41J 2/17556; B41J 2/17553; B41J 2/175; B41J 2002/17516; B41J 2/19
See application file for complete search history.

(56) References Cited

U.S. PATENT DOCUMENTS 4,558,326 A * 12/1985 Kimura ..... B41J 2/16526 347/26
5,852,458 A 12/1998 Scheffelin et al.
(Continued)

FOREIGN PATENT DOCUMENTS

CN 1371810 A 10/2002
EP 0778146 A1 6/1997
(Continued)

OTHER PUBLICATIONS

Wen, et al. A Study of the Ink Reservoir for the Inkjet System 1 Page.

*Primary Examiner* — Bradley W Thies
(74) *Attorney, Agent, or Firm* — HP Inc. Patent Department

(57) ABSTRACT

A printing fluid cartridge (104) for a pumped printing fluid system containing a pump (110) is described, the printing fluid cartridge (104) comprising a housing (120) defining an interior chamber (122); a collapsible bag (124) within the chamber for holding a supply of printing fluid (126); and a fluid connection member (106) for forming a fluid connection between the collapsible bag (124) and an upstream side of the pump (110). The housing (120) includes a structure allowing the application of manual pressure to the collapsible bag (124) to urge printing fluid out of the collapsible bag through the fluid connection member (106) to the upstream side of the pump (110) to displace air (130) in the fluid connection member (106) and the pump (110).

14 Claims, 4 Drawing Sheets

(52) U.S. Cl.
CPC ..... *B41J 2/17553* (2013.01); *B41J 2/17556* (2013.01); *B41J 2/19* (2013.01); *B41J 2002/17516* (2013.01)

(56) References Cited

U.S. PATENT DOCUMENTS

| | | | |
|---|---|---|---|
| 6,183,073 | B1 | 2/2001 | Rottman et al. |
| 6,290,343 | B1 | 9/2001 | Lewis et al. |
| 2003/0007040 | A1 | 1/2003 | Love et al. |
| 2005/0046681 | A1 | 3/2005 | Kumagai et al. |

FOREIGN PATENT DOCUMENTS

| | | | | |
|---|---|---|---|---|
| EP | 0857576 | | | 8/1998 |
| EP | 2596953 | A1 | | 5/2013 |
| JP | 60204361 | A | | 10/1985 |
| JP | 08290584 | A | | 11/1996 |
| JP | 2004181766 | A | | 7/2004 |
| JP | 2004188857 | A | | 7/2004 |
| JP | 2006281590 | | | 10/2006 |
| JP | 2006281590 | A | * | 10/2006 |
| JP | 2010143069 | A | | 7/2010 |
| WO | WO-2006075514 | A1 | | 7/2006 |

* cited by examiner

PRINTING FLUID CARTRIDGE FOR A PUMPED PRINTING FLUID SYSTEM

BACKGROUND

Many types of printing systems are known and commonly used, and various printing technologies exist. In many such printing systems, printing fluid is supplied to a print head from consumable printing fluid cartridges. In certain high-production cases, those consumable printing fluid cartridges may not hold sufficient volumes of printing fluid to be practical, so higher capacity auxiliary printing fluid supplies have been developed. The higher capacity printing fluid auxiliary supplies may be connected to a printing device, with pumped delivery of the printing fluid from the auxiliary supply to the printing device.

BRIEF DESCRIPTION OF THE DRAWINGS

Examples of a printing fluid cartridge for a pumped printing fluid system and associated methods of installation are further described below with reference to the accompanying drawings, in which.

DETAILED DESCRIPTION

Figure 1:
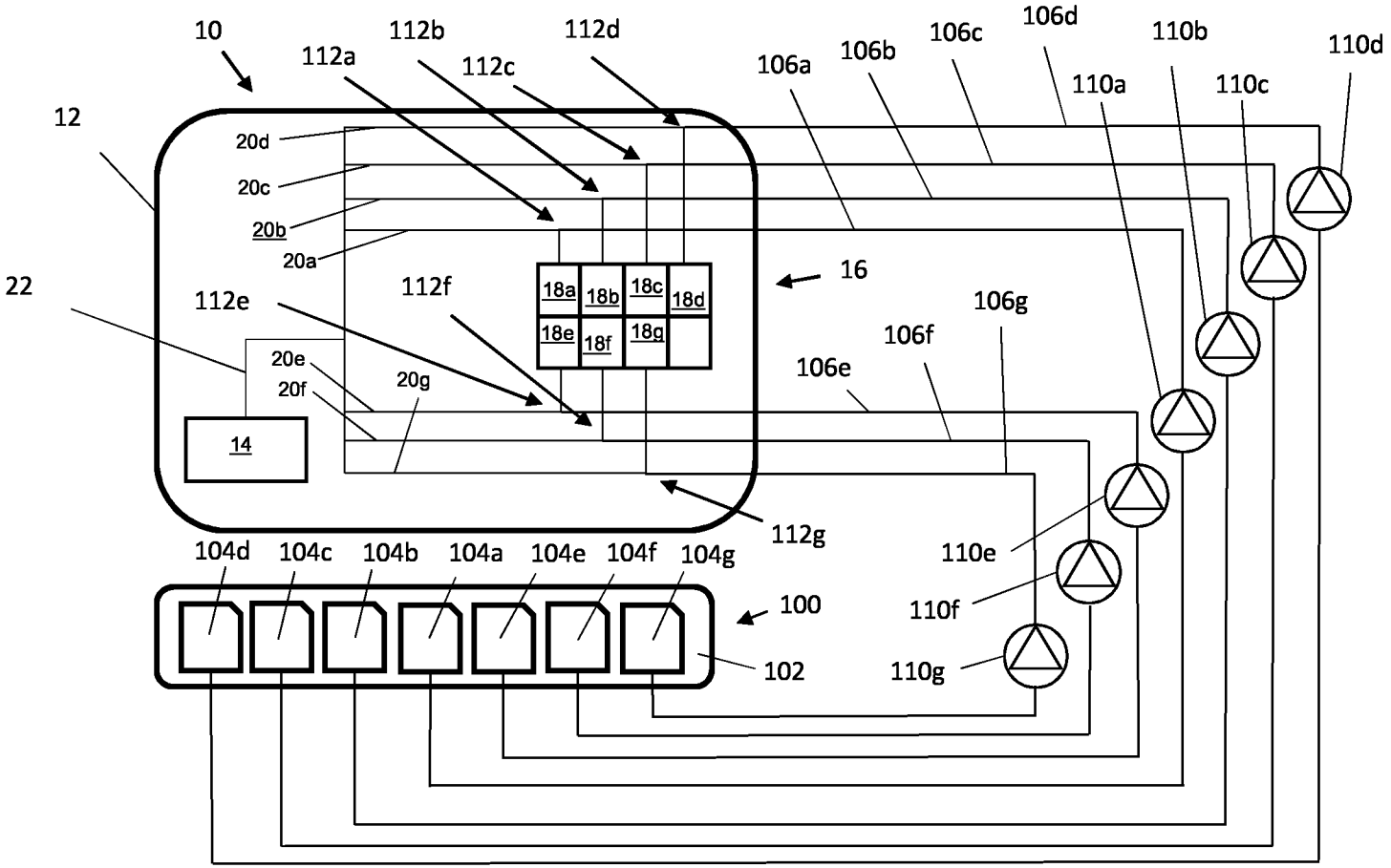
FIG. 1 shows a printing system comprising an auxiliary printing fluid supply comprising a plurality of high-capacity printing fluid cartridges each attached to a printing device via a respective pump.

A printing device 10 is shown in FIG. 1. The printing device (also referred to as a printer) 10 comprises a housing 12 containing a print head 14 in fluid connection with an on-board printing fluid supply 16. The printing fluid supply 16 may comprise multiple individual replaceable or refillable cartridges 18*a-g*. Each cartridge 18*a-g* may contain a different colour printing fluid, for example, to enable colour printing. The individual cartridges 18*a-g* each have an associated fluid line or conduit 20*a-g* to deliver the printing fluid to the print head 14. For simplicity, the individual conduits 20*a-g* are shown as joining a common conduit 22 prior to entry into the print head 14. As illustrated, there are seven separate cartridges and associated printing fluid lines, but it will be appreciated that any number could be employed, including just a single cartridge.

For high productivity users of such printers 10, the on-board printing fluid supply 16 (which may, for example, be a maximum of 775 cc per cartridge) may not have sufficient capacity, requiring frequent replacement or replenishment of the printing fluid cartridges 18*a-g*. To address this issue, auxiliary printing fluid supplies have been developed for connection to the printer 10 to supplement the on-board supply 16 with higher-capacity cartridges (of, for example, approximately 3000 cc capacity per cartridge). One such auxiliary printing fluid supply 100 is shown in FIG. 1. The auxiliary printing fluid supply 100 comprises a base 102 on which is mounted a plurality of high-capacity printing fluid cartridges 104*a-g*, corresponding to the number of on-board cartridges 18*a-g* (which hereinafter can be considered as intermediate printing fluid cartridges). Accordingly, here there are seven high-capacity printing fluid cartridges 104*a-g*.

Each high-capacity cartridge 104*a-g* is connected to the corresponding on-board cartridge 18*a-g* via a supplemental printing fluid conduit or line 106*a-g*, each of which includes a pump 110*a-g* to urge the printing fluid from the high-capacity cartridge 104*a-g* to the associated intermediate printing fluid cartridge 18*a-g* and onward to the print head 14. In effect, the high-capacity cartridges 104*a-g* refill the intermediate printing fluid cartridges 18*a-g* as desired. Supply of printing fluid from the intermediate printing fluid cartridges 18*a-g* to the print head 14 may be as otherwise would occur in a printer without the auxiliary printing fluid supply 100.

For example, each intermediate printing fluid cartridge 18 may comprise a rigid outer housing containing an inner squeezable plastic flexible bag that is filled with printing fluid, and has a printing fluid connection interface for forming a connection to a fluid flow path to the print head 14. The cartridge 18 may also include a security chip. Printing fluid may be urged out of the cartridge 18 by pressurising the space between the outer housing and the inner bag with air.

The pumps 110*a-g* may be diaphragm pumps. The respective fluid flow paths from the higher capacity printing fluid cartridges 104*a-g* to the print head 14 via the pumps 110*a-g*, the intermediate printing fluid cartridges 18*a-g* and the conduits 106*a-g*, 20*a-g*, 22 together comprise a printing fluid delivery system.

On first installing such an auxiliary printing fluid supply 100 to a printer 10, the conduits 106*a-g* and the pumps may be full of air and it can be helpful to purge the printing fluid delivery system of such air because air trapped in the system can prevent the printer from producing satisfactory print quality or even from functioning at all, due to the fact that this may prevent the printing fluid from reaching the print head 14 as intended.

Currently on installation, the pumps 110 may attempt to purge the printing fluid delivery system of air automatically. However, this may not always be successful, due to the compressibility of air. Installers therefore sometimes purge the printing fluid delivery system manually. To do this, for each line 106 they connect a syringe downstream of the pump 110—for example at a junction 112 between the line 106 and the associated conduit 20. Withdrawing the syringe's plunger causes a negative pressure in the line, which urges printing fluid out of the higher-capacity printing fluid cartridge 104, through the line 106 to the pump 110, thereby displacing air in the system upstream of the syringe and in particular on the upstream side of the pump 110. Once the air has been purged from the system, the syringe is removed and the junction 112 is reconnected. This manual purge can be a very labour-intensive, messy and time-consuming procedure, and can lead to large wastage of printing fluid. To account for this wastage, additional printing fluid volumes are currently included in the auxiliary printing fluid supply 100, which can be very costly (for example costing an additional $45 to provide that extra purge printing fluid).

Figure 2A:
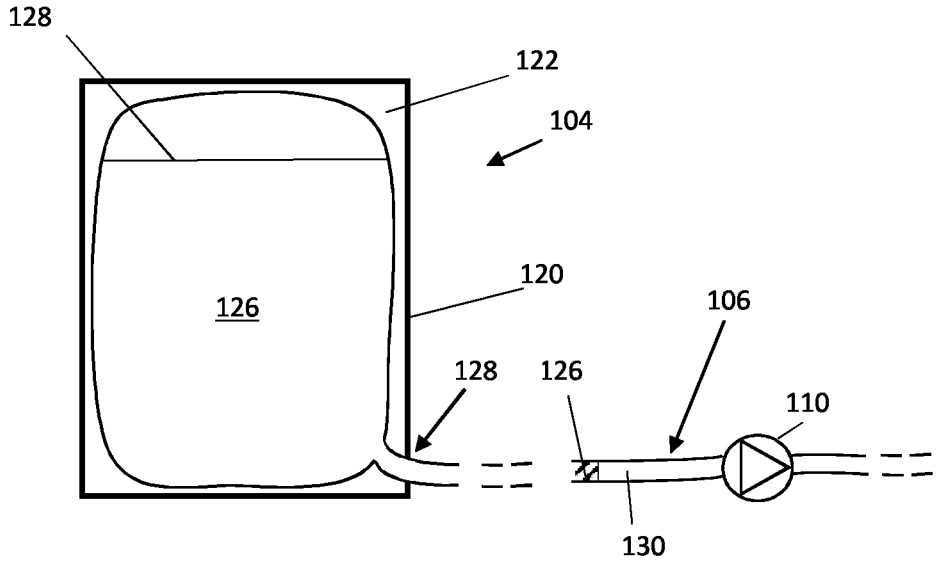
FIG. 2*a* is a schematic cross-sectional view through a printing fluid cartridge according to one example, with associated pump and fluid connections.

An example of a high-capacity auxiliary printing fluid cartridge 104 is shown in FIG. 2*a*. The cartridge 104 has an outer housing 120 made of cardboard and defining an interior chamber 122. Inside the chamber 122 is a collapsible bag 124 containing a volume of printing fluid 126. The capacity of the bag 124 may be in the range of 1000 cc up to 10,000 cc. In some examples, the capacity is 3000 cc.

A conduit 106 forms a fluid connection at one end with the interior of the collapsible bag 122, and thus with the printing fluid 126. At the other end of the conduit 106, a fluid connection is formed with the respective intermediate on-board printing fluid cartridge 18, as described in the introduction. In another example, the fluid conduit 106 may form a direct connection with the print head 14, by-passing any intermediate printing fluid supplies. In either instance, printing fluid 126 is urged through the conduit 106 from the high-capacity auxiliary printing fluid cartridge 104 by means of a pump 110.

In certain examples, the conduit 106 may be separably connectable to the high-capacity printing fluid cartridge 104, for example by connecting to an outlet 128 on the cartridge housing 120 such as a luer connector, which outlet is in turn in fluid communication with the interior of the collapsible bag 124. Thus, cartridges 104 may be supplied independently of the associated conduit 106 and pump 110.

On initial installation of the high-capacity printing fluid supply 100, air 130 may become trapped in the conduit 106 between the printing fluid 126 and the pump 110. As a result, the pump 100 may attempt to pump air from its upstream chamber rather than printing fluid and may malfunction. To address this, the high-capacity cartridge housing 120 includes a structure to apply pressure manually to the collapsible bag 124, thereby urging the printing fluid 126 along the conduit 106 and pushing any trapped air 130 along the conduit 106 until the upstream chamber of the pump 110 is entirely filled with printing fluid.

Figure 2B:
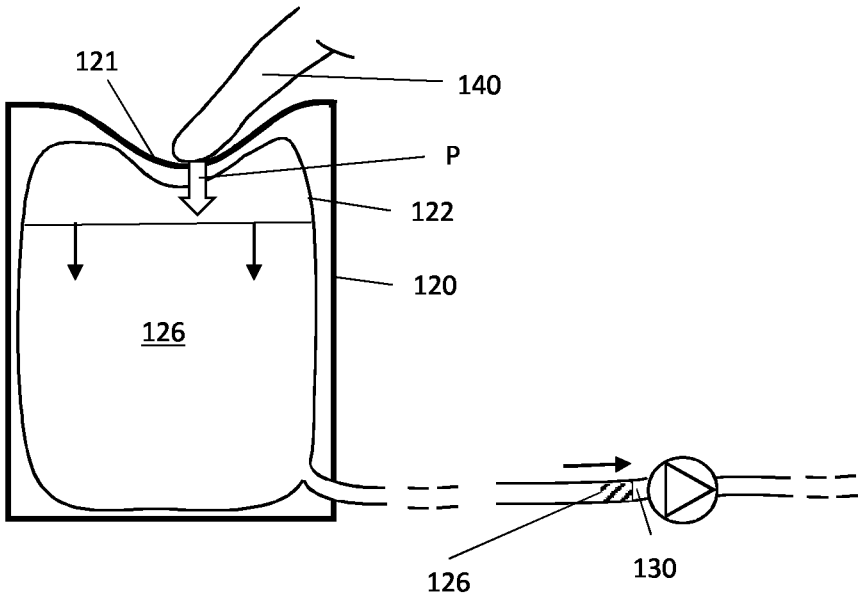
FIG. 2*b* corresponds to FIG. 2*a*, but showing a flexible bag within the cartridge being pressed by a user's finger.

In one example, shown in FIG. 2*b*, the housing 120 includes at least a portion 121 that is flexible and therefore can be manipulated by manual pressure, such as downward pressure P from a user's finger 140. This downward pressure P deflects the portion of the housing 121 and, in turn, squeezes the collapsible bag 124, raising the pressure in the bag and causing the printing fluid 126 to flow along the conduit 106. The pressure P can be maintained until all air 130 from the upstream side of the pump 110 has been displaced. Once that has occurred, the pump 110 is primed and can reliably be operated to urge the printing fluid 126 downstream, onwards ultimately to the print head 14 for printing therefrom. The flexible portion 121 may be formed of cardboard. The entire housing 120 may be formed of cardboard, and the entire housing may be deformable under manual manipulation.

In contrast to the indirect application of manual pressure of the example of FIG. 2*b*, where the pressure is applied to the collapsible bag 124 via the flexible portion 121 of the housing, pressure may instead be applied directly to the collapsible bag 124. The high-capacity printing fluid cartridge 104 shown in FIGS. 3*a* and 3*b* includes an example of such another structure for applying manual pressure directly.

Here, the housing 120 includes a hinged flap 150 that can be displaced to reveal an opening 160 providing direct access to the collapsible bag 124 within. The hinged flap 150 is connected to the rest of the housing 120 by a hinge line 152, and has free sides defined by edges 154. The free edges 154 may be defined by a series of perforations 156 through the housing 120. The user can therefore release the flap 150 by breaking the perforations 156, and can then hinge the flap open to one side (see FIG. 3*b*) before pressing directly on the collapsible bag 124 with their finger 140.

The hinged flap 150 is illustrated as being provided on an upper side of the housing 120, but it will be understood that it could be sited at any convenient location on the housing, depending on where would be most accessible in use in the auxiliary printing fluid supply 100.

Figure 3A:
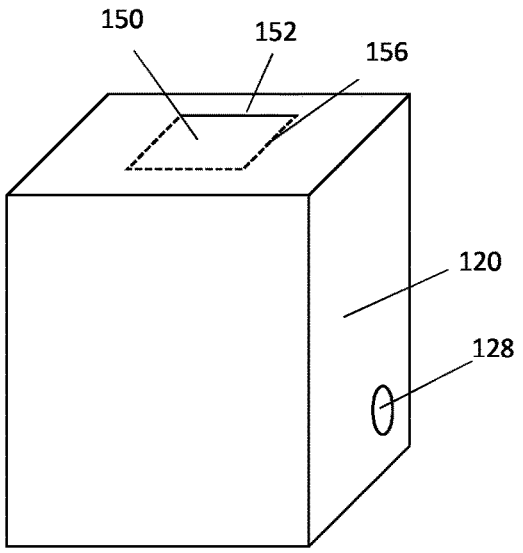
FIGS. 3*a* and 3*b* are schematic perspective views of a printing fluid cartridge according to another example, with a moveable flap to provide access to the flexible bag within, in respective closed and open positions.
Figure 3B:
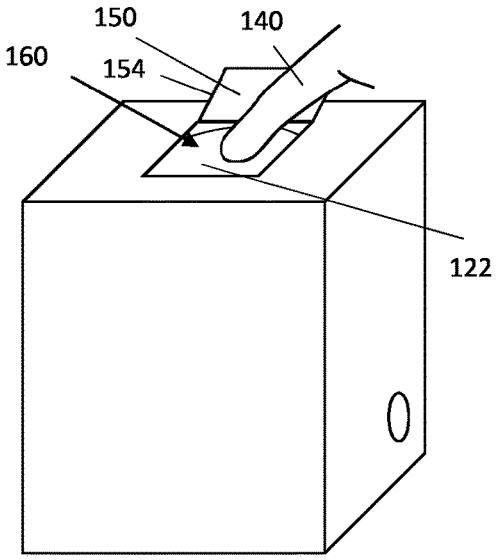

A high-capacity printing fluid cartridge 104 of the type shown in FIGS. 3*a* and 3*b* might also be used in a different way, by instead of hinging the flap 150 open outwardly to one side, deflecting it inwardly towards the collapsible bag 124, and applying pressure manually to the collapsible bag 124 indirectly via the flap 150.

Figure 4A:
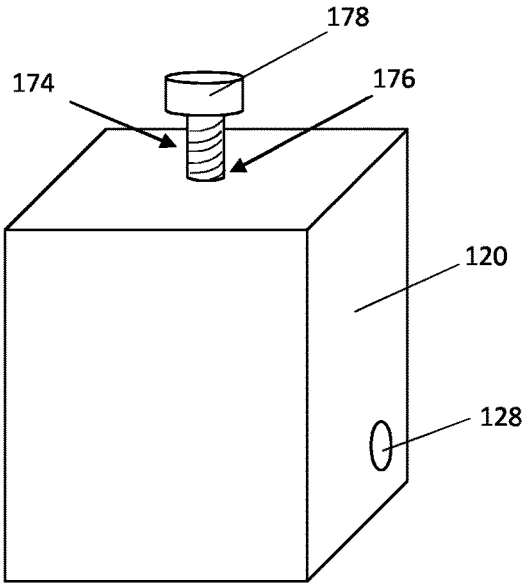
FIGS. 4*a* and 4*b* are respective schematic perspective and cross-sectional views of a printing fluid cartridge according to yet another example, with an internal bracing mechanism for applying pressure to the flexible bag within, actuated by means of an externally accessible screw.
Figure 4B:
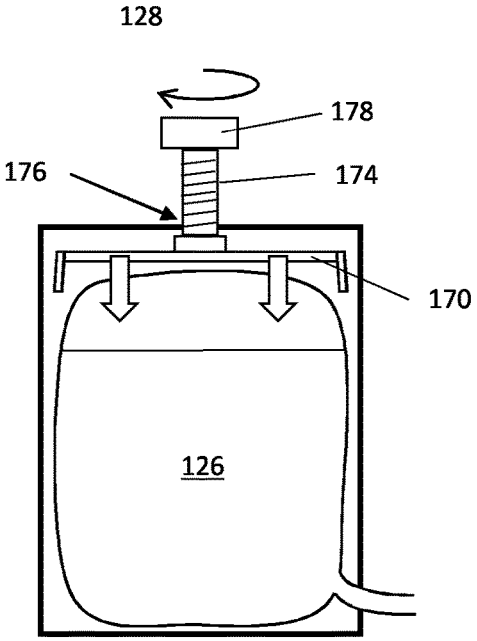

Another high-capacity printing fluid cartridge 104 is shown in FIGS. 4*a* and 4*b*. In this example, the housing chamber 122 includes a bag-embracing mechanism 170 that can be displaced downwardly to apply pressure to the collapsible bag 124. The bag-embracing mechanism 170 comprises a plate 172 in direct contact with the top of the collapsible bag 124. The plate 172 is connected to a shaft 174 that projects through an opening 176 in the housing 120. The shaft 174 is threaded and there is a corresponding mated threaded connection on the housing, either within the opening 176 or provided by a nut (not shown) securely attached to the housing. Manually turning the shaft 174 results in vertical displacement of the plate 172 and, as a result, in the application of pressure to the collapsible bag 124. A knob 178 may be provided on the free end of the shaft 174 to facilitate its manipulation by a user.

So, many different structures for applying manual pressure to the collapsible bag 124 are envisaged. With each, the structure is provided integrally with the housing 120 of the high-capacity printing fluid cartridge 104 and can be operated once the cartridge 104 is connected to the auxiliary printing fluid supply 100 and the auxiliary printing fluid supply 100 is connected to the printer 10. Separate equipment may or may not be used in the installation process.

Figure 5:
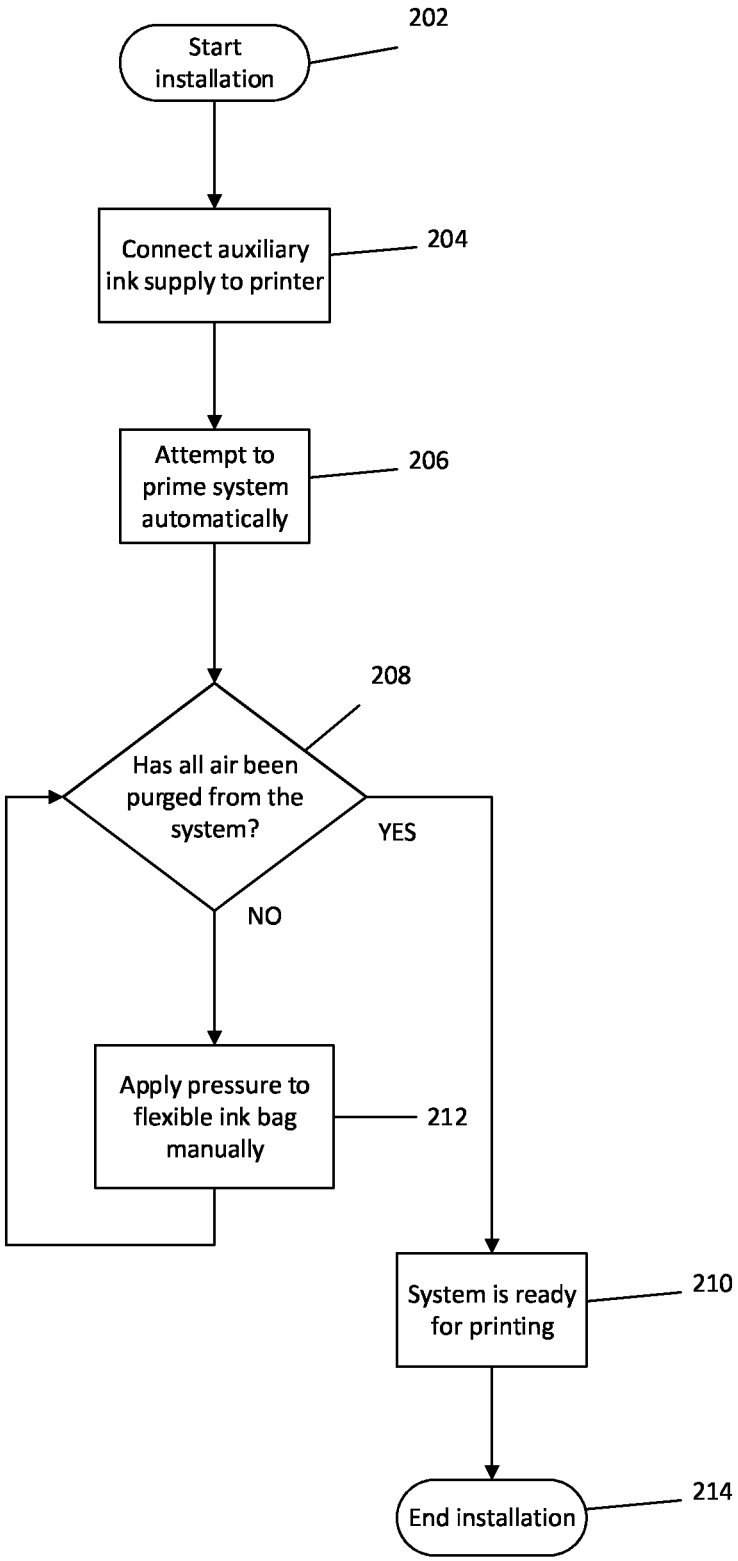
FIG. 5 is a flowchart of a process for installing a printing fluid cartridge according to one example.

The installation process will now be described with reference to FIG. 5. At block 202 the installation process begins. The auxiliary printing fluid supply 100 is connected to the printer 10 at block 204. This may involve connecting the conduit 106 from each high-capacity printing fluid cartridge 104 to a respective connector on the exterior of the printer 10 to form a fluid connection with the associated on-board (intermediate) printing fluid cartridge 18 of the printing fluid supply 16. All fluid connections may be made in a single action. The auxiliary printing fluid supply 100 may also be securely attached to the printer 10 by other physical connections such as cooperative fastenings.

A high-capacity printing fluid cartridge 104 may first be installed on to the base 102 of the auxiliary printing fluid supply 100. Alternatively or in addition, each high-capacity printing fluid cartridge 104 may already be installed on the base 102.

After initial connection of the auxiliary printing fluid supply 100 to the printer 10, an attempt may be made to prime the system automatically, at block 206. Here, the pump 110 associated with each high-capacity printing fluid cartridge 104 is actuated to try to pump printing fluid 126 from the collapsible bag 124 onwards down the conduit 106. If this is proven at block 208 to be successful, for each high-capacity printing fluid cartridge 104, corresponding to each colour, then it is declared that all air has been purged from the system and the system is ready for printing at block 210 and the installation process can finish at block 212. If, on the other hand, it is decided at block 208 that the automatic priming process has failed, because of air remaining in the system upstream of the pump 110, then the installer can intervene to take manual actions to purge air from the system.

Specifically, the installer can, at block 212, apply pressure to the collapsible bag 124 manually using any of the means for doing so described above. The system can be tested periodically during this manual process to determine if all air has been purged from the system. Once at least the air 130 in the system upstream of the pump 110 has been purged, then the automated priming process may take over to purge the remains of the system of air.

Thus, in some installations the automated purging process may function without user intervention. For those installations where manual intervention is used, this can be kept to a minimum and can be semi-automated, with the automated purging process taking over once air 130 upstream of the pump 110 has been purged.

It will be understood that the delivery of printing fluid may be direct from the high-capacity printing fluid cartridges 104 to the print head 14, by-passing any intermediate printing fluid supply 16.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect or example described herein are to be understood to be applicable to any other aspect or example described herein unless incompatible therewith. All of the features disclosed in this specification (including any accompanying claims, abstract and drawings), and/or all of the actions of any method or process so disclosed, may be combined in any combination, except combinations where at least some of such features and/or actions are mutually exclusive. The invention is not restricted to the details of any foregoing examples. The invention extends to any novel one, or any novel combination, of the features disclosed in this specification (including any accompanying claims, abstract and drawings), or to any novel one, or any novel combination, of the actions of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A printing fluid cartridge for a pumped printing fluid system containing a pump, the printing fluid cartridge comprising:

a housing defining an interior chamber;

a collapsible bag within the chamber to hold a supply of printing fluid; and a fluid connection member to form a fluid connection between the collapsible bag and an upstream side of the pump, wherein the housing comprises a structure to allow the application of manual pressure to the collapsible bag to urge printing fluid out of the collapsible bag through the fluid connection member to the upstream side of the pump to displace air in the fluid connection member and the pump.

2. The printing fluid cartridge of claim 1, wherein the housing structure is at least partially constructed of a flexible material, which comprises means for applying manual pressure to the collapsible bag.

3. The printing fluid cartridge of claim 1, wherein the housing structure includes a displaceable portion which comprises means for applying manual pressure to the collapsible bag.

4. The printing fluid cartridge of claim 3, wherein manual pressure can be applied indirectly to the collapsible bag via the displaceable portion of the housing.

5. The printing fluid cartridge of claim 4, wherein the displaceable portion of the housing comprises a hinged flap.

6. The printing fluid cartridge of claim 3, wherein manual pressure can be applied directly to the collapsible bag by first displacing the displaceable portion of the housing in a direction different to that of the application of the manual pressure.

7. The printing fluid cartridge of claim 1, in which the collapsible bag has a capacity in the range of 1000 cc to 10,000 cc.

8. A pumped printing fluid system comprising:

a print head; and a printing fluid cartridge comprising:

a housing defining an interior chamber;

a collapsible bag within the chamber to hold a supply of printing fluid; and a fluid connection member to form a fluid connection between the collapsible bag and an upstream side of a pump, wherein the housing comprises a structure to allow the application of manual pressure to the collapsible bag to urge printing fluid out of the collapsible bag through the fluid connection member to the upstream side of the pump to displace air in the fluid connection member and the pump, wherein the pump comprises an inlet in fluid connection with the fluid connection member of the printing fluid cartridge at the upstream side of the pump, and wherein the pump further comprises an outlet in fluid connection with the print head.

9. The pumped printing fluid system of claim 8, further comprising a first fluid conduit interconnecting the fluid connection member of the printing fluid cartridge and the pump inlet, and a second fluid conduit interconnecting the pump outlet with the print head.

10. The pumped printing fluid system of claim 9, further comprising an intermediary printing fluid supply between the pump outlet and the print head, the second conduit comprising a first portion interconnecting the pump outlet and an inlet to the intermediary printing fluid supply and a second portion interconnecting an outlet of the intermediary printing fluid supply and the print head.

11. The pumped printing fluid system of claim 8, wherein the pump is a diaphragm pump.

12. A method of purging a printing fluid supply pump, comprising:

connecting a printing fluid cartridge to the pump, the printing fluid cartridge comprising a housing defining an interior chamber, and a collapsible bag within the chamber for holding a supply of printing fluid, wherein the housing comprises a structure allowing the application of manual pressure to the collapsible bag, such that the supply of printing fluid is in fluid communication with an upstream side of the pump; and manually applying pressure to the collapsible bag via the housing structure, thereby urging printing fluid out of the collapsible bag until air in the fluid connection member and the pump has been displaced.

13. The method of claim 12, further comprising connecting a downstream side of the pump to a printing device.

14. The method of claim 13, wherein the housing structure comprises a displaceable flap, the method further comprising displacing the flap to expose an aperture in the housing, and wherein manually applying pressure to the collapsible bag comprises pressing on the bag through the aperture.

* * * * *